US008070532B1

(12) United States Patent
Sun

(10) Patent No.: US 8,070,532 B1
(45) Date of Patent: Dec. 6, 2011

(54) ELECTRICAL CONNECTOR ASSEMBLY WITH ANTI-MISMATCHING MATING CONNECTORS

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/910,850

(22) Filed: Oct. 24, 2010

(30) Foreign Application Priority Data

Jun. 28, 2010 (CN) ..... 2010 1 0210970

(51) Int. Cl.
*H01R 13/64* (2006.01)

(52) U.S. Cl. ..... 439/677

(58) Field of Classification Search ..... 439/677, 439/692, 680, 682, 620.01–620.02
See application file for complete search history.

(56) References Cited

U.S. PATENT DOCUMENTS 5,470,252 A * 11/1995 Fladung ..... 439/490
5,885,088 A * 3/1999 Brennan et al. ..... 439/680
6,457,988 B1 * 10/2002 Andersen ..... 439/373
6,468,095 B2 * 10/2002 Kerr et al. ..... 439/140
6,674,003 B1 * 1/2004 Torres ..... 174/66
7,311,558 B2 * 12/2007 Adams et al. ..... 439/680
D585,378 S * 1/2009 Haber ..... D13/138.2
7,641,517 B2 * 1/2010 Vogt et al. ..... 439/620.02
7,749,029 B1 * 7/2010 Pontillo, II ..... 439/678

* cited by examiner

*Primary Examiner* — Jean F Duverne
(74) *Attorney, Agent, or Firm* — Altis Law Group, Inc.

(57) ABSTRACT

An exemplary electrical connector assembly includes an insert connector and a receiving connector. The insert connector includes a first pin and a second pin. The receiving connector defines a first and a second holes corresponding to the first and second pins of the insert connector, respectively. The first hole has a shape and a size matching the first pin, and the second hole has a shape and a size matching the second pin. The first and second pins of the insert connector are respectively extendable into and engagable in the first and second holes of the receiving connector. A transverse cross sectional area of the second pin is larger than that of the first pin, whereby the second pin of the insert connector is prevented from being received in the first through hole of the receiving connector.

8 Claims, 5 Drawing Sheets

ELECTRICAL CONNECTOR ASSEMBLY WITH ANTI-MISMATCHING MATING CONNECTORS

BACKGROUND

1. Technical Field

The present disclosure relates to electrical connectors, and particularly to an electrical connector assembly having a receiving connector and a mating insert connector configured to prevent mismatching therebetween.

2. Description of Related Art

Electrical connector assemblies are commonly used for electrically connecting an electronic component to a drive circuit in an electronic device, such as in a computer. Generally, an electrical connector assembly includes an insert connector electrically connected with a drive circuit, and a receiving connector electrically connected with an electronic component. The insert connector includes a first pin and a second pin. The first and second pins are the same shape and size, and are electrically connected with a positive pole and a negative pole of the drive circuit, respectively. The receiving connector defines a pair of first and second holes therein corresponding to the first and second pins of the insert connector, respectively. The first and second holes are the same shape and size. Two conductors are received in the first and second holes, respectively, and are electrically connected with a positive pole and a negative pole of the electronic component. The first pin of the insert connector is received in the first hole of the receiving connector, and contacts the conductor in the first hole to electrically connect the positive pole of the drive circuit to the positive pole of the electronic component. The second pin of the insert connector is received in the second hole of the receiving connector, and contacts the conductor in the second hole to electrically connect the negative pole of the drive circuit to the negative pole of the electronic component.

However, as the first and second pins of the insert connector are the same shape and size, they are easily confused with each other, as are the first and second holes. Erroneous connection may thus occur, resulting in a short circuit, which may damage the electronic component.

Thus, there is a need for an electrical connector assembly which can overcome the described limitations.

DETAILED DESCRIPTION

Figure 1:
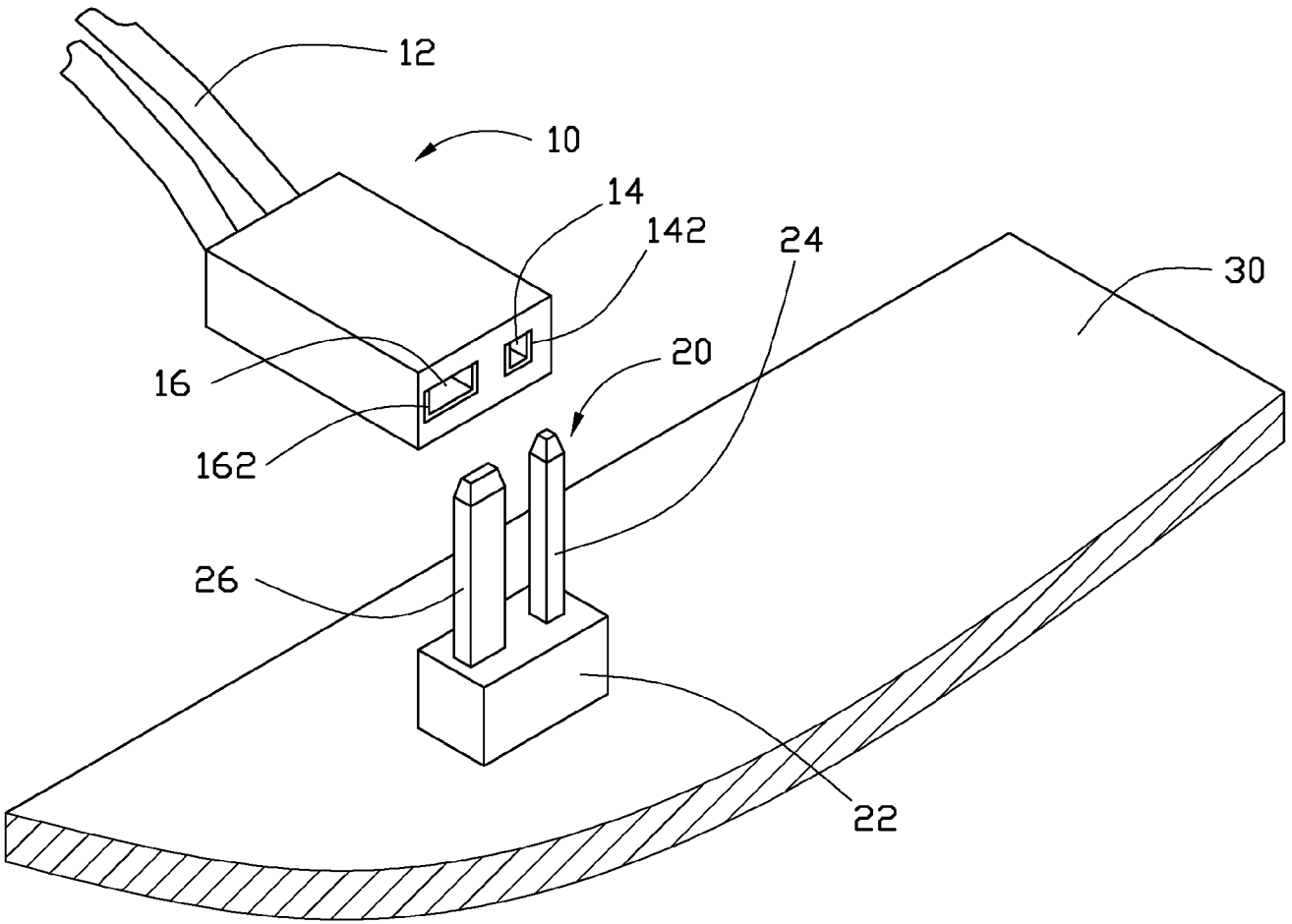
FIG. 1 is essentially an isometric view of an electrical connector assembly in accordance with a first embodiment, showing a receiving connector disconnected from an insert connector.
Figure 2:
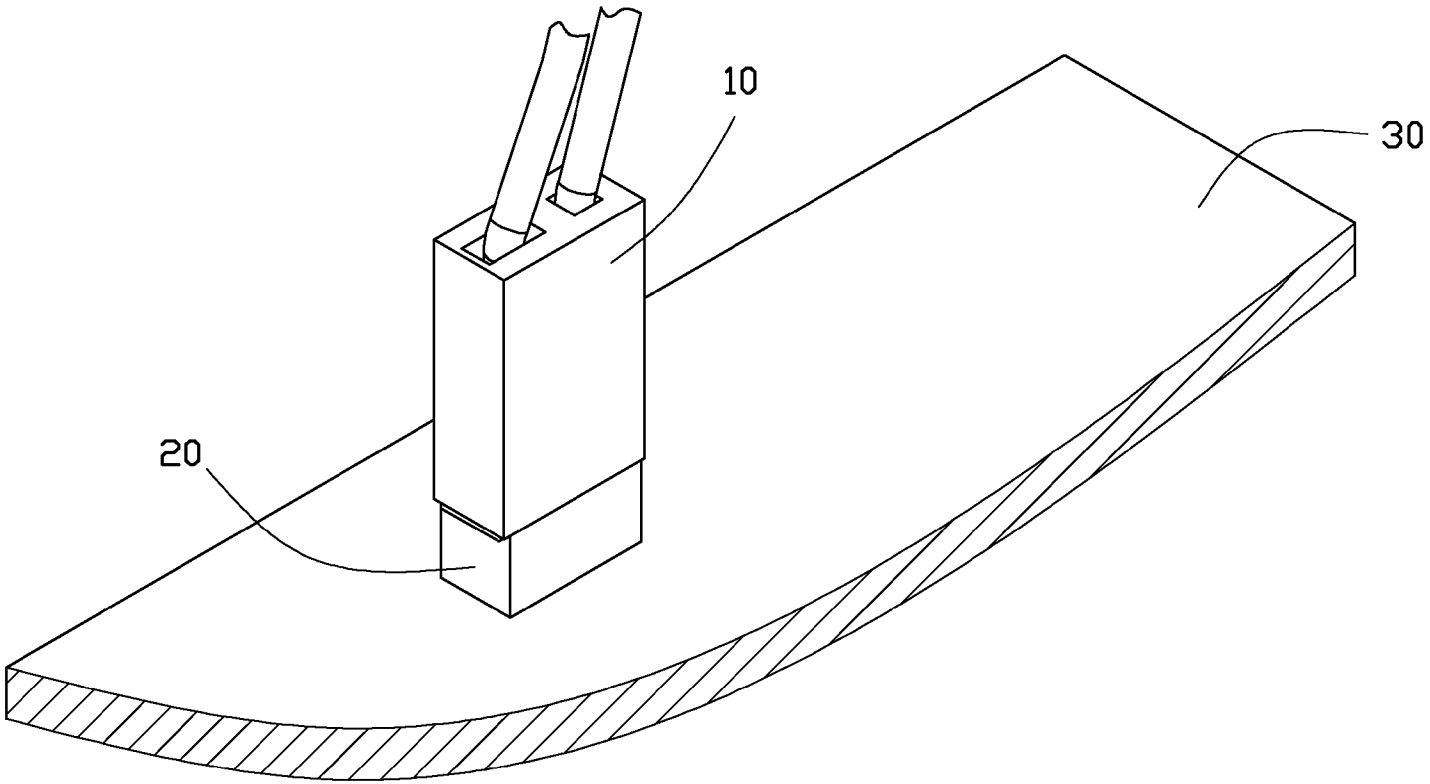
FIG. 2 is an assembled view of the electrical connector assembly of FIG. 1.

Referring to FIGS. 1 and 2, an electrical connector assembly according to a first embodiment is shown. The electrical connector assembly includes a receiving connector 10 and an insert connector 20. In this embodiment, the insert connector 20 is mounted on a circuit board 30 and electrically connected with a drive circuit formed on the circuit board 30. The receiving connector 10 is electrically connected with an electronic component (not shown) by cables 12. When the receiving connector 10 is connected with the insert connector 20, the electronic component is electrically connected to the drive circuit, such that the drive circuit can provide a current to the electronic component.

The insert connector 20 includes a rectangular main body 22 formed on the circuit board 30, and a first and a second elongated pins 24, 26 extending through and out of a top of the main body 22. The main body 22 is made of electrically insulative material, while the first and second pins 24, 26 are made of material with good electrical conductivity, such as metal. Bottom ends of the first and second pins 24, 26 are electrically connected with a positive pole and a negative pole of the drive circuit, respectively. The first and second pins 24, 26 extend upwardly and out of the top of the main body 22. Lengths of the first and second pins 24, 26 protruding out of the main body 22 are the same. Top ends of the first and second pins 24, 26 are located at the same level.

Figure 3:
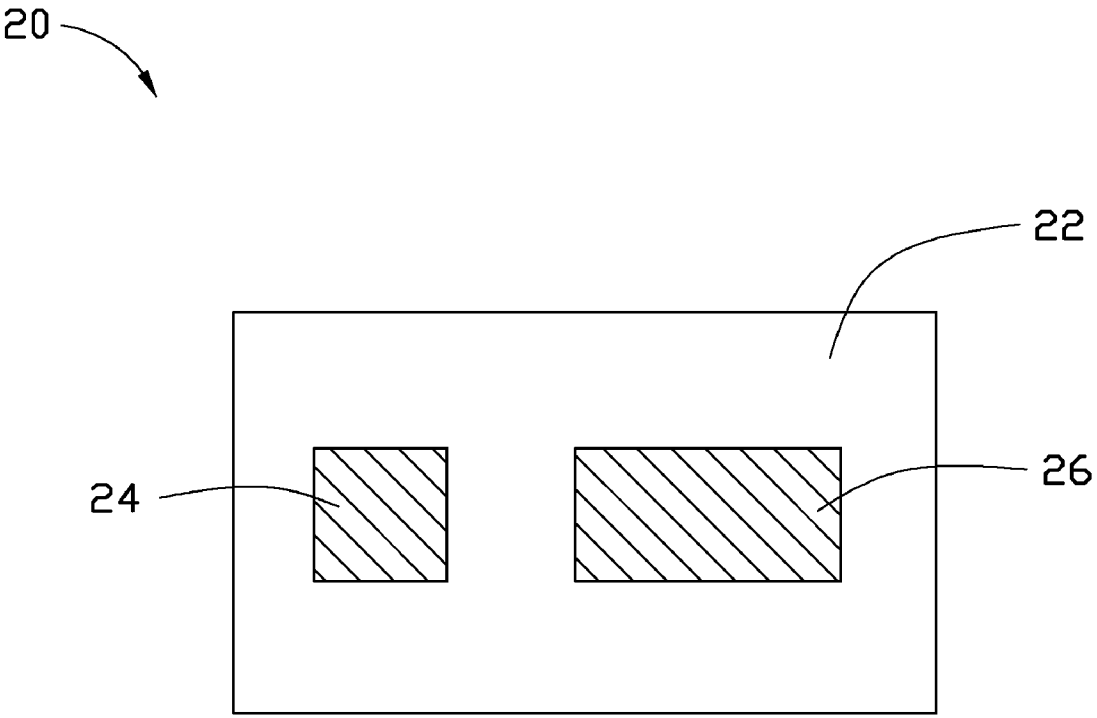
FIG. 3 is an enlarged cross section of the insert connector of FIG. 1.

Referring also to FIG. 3, the first pin 24 of the insert connector 20 has a square cross section. The second pin 26 has a rectangular (non-square) cross section. The width of the cross section of the second pin 26 is equal to the width of the first pin 24. The length of the cross section of the second pin 26 exceeds the length of the first pin 24, whereby the size of the cross section of the second pin 26 is greater that of the first pin 24.

The receiving connector 10 is substantially rectangular, with a first and a second through holes 14, 16 defined therein. The first and second through holes 14, 16 are parallel. Two conductors 142, 162 are received in the first and second through holes 14, 16, respectively. The cables 12 are connected at one side of the receiving connector 10. The conductors 142, 162 are electrically connected with a positive pole and a negative pole of the electronic component by the cables 12, respectively. The first through hole 14 has a shape and a size matching the first pin 24 of the insert connector 20, and the second through hole 16 has a shape and a size matching the second pin 26 of the insert connector 20. Thus, the first and second pins 24, 26 of the insert connector 20 can be received in the first and second through holes 14, 16 of the receiving connector 10.

During assembly, the first and second through holes 14, 16 of the receiving connector 10 are aligned with the first and second pins 24, 26 of the insert connector 20, respectively. Then the first pin 24 extends into the first through hole 14 of the receiving connector 10 and contacts the conductor 142 in the first through hole 14, to thereby connect the positive pole of the electronic component to the positive pole of the drive circuit. Simultaneously, the second pin 26 extends into the second through hole 16 of the receiving connector 10 and contacts the conductor 162 in the second through hole 16, to thereby connect the negative pole of the electronic component to the negative pole of the drive circuit. Thus, the electronic component is electrically connected to the drive circuit correctly.

As the cross section of the first pin 24 is square, and the cross section of the second pins 26 is rectangular, the first and second pins 24, 26 are easily differentiated from each other, as are the first and second through holes 14, 16. Thus correct connection between the receiving connector 10 and the insert connector 20 is easy to achieve. Even if the first pin 24 is mistakenly aligned with the second through hole 16 and the second pin 26 with the first through hole 14, the second pin 26 cannot be received in the first through hole 14, being too large.

In this embodiment, the cross section of the first pin 24 is square, and the cross section of the second pin 26 is rectangular. Alternatively, the first and second pins 24, 26 can have other shapes and/or sizes.

Figure 4:
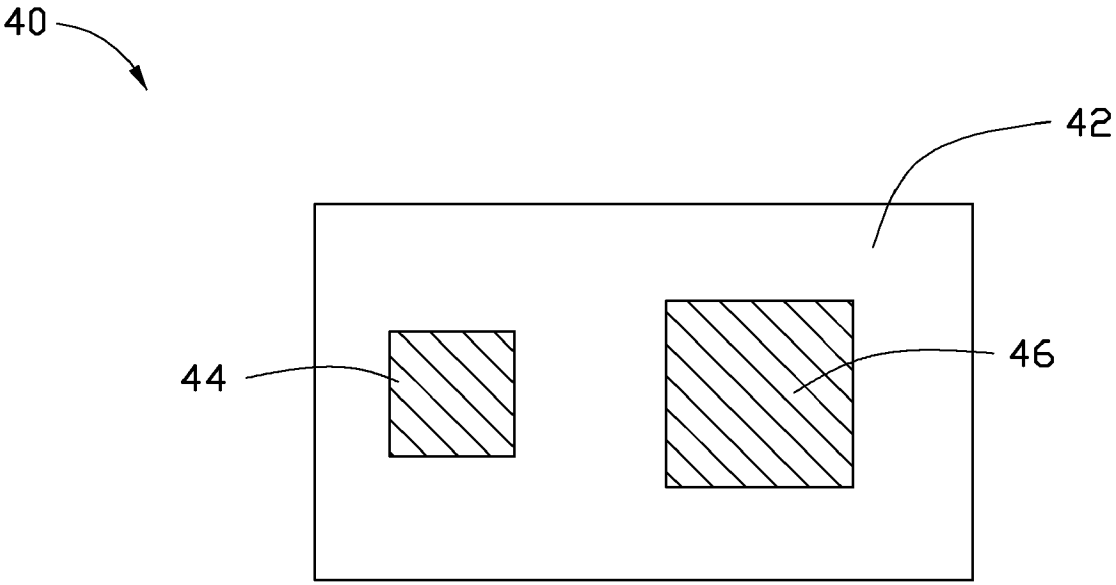
FIG. 4 is a cross section of an insert connector of an electrical connector assembly in accordance with a second embodiment.

FIG. 4 shows a cross section of an insert connector 40 of an electrical connector assembly accordingly to a second embodiment. The insert connector 40 is similar to the insert connector 20 of the electrical connector assembly of the first embodiment. In particular, the insert connector 40 includes a main body 42, and a first and a second pins 44, 46 mounted in the main body 42. The insert connector 40 differs from the insert connector 20 of the electrical connector assembly of the first embodiment as follows. The first pin 44 and the second pin 46 have the same shape in cross section. In particular, both the first and second pins 44, 46 are rectangular in cross section. The cross section of the first pin 44 has a ratio of length to width equaling that of the second pin 46. However, the cross section of the second pin 46 is larger than that of the first pin 44. That is, the length and width of the cross section of the second pin 46 are longer than those of the first pin 44, respectively.

Correspondingly, a receiving connector (not shown) matching the insert connector 40 defines a first and a second through holes to match the first and second pins 44, 46 of the insert connector 40, respectively. The first hole has a shape and a size matching the first pin 44, and the second hole has a shape and a size matching the second pin 46. Thus, the second pin 46 cannot be received in the first through hole of the receiving connector, and misconnection between the insert connector 40 and the receiving connector is prevented. In the illustrated embodiment, both the first and second pins 44, 46 are square. Alternatively, the first and second pins 44, 46 can have circular cross sections, with the diameter of the cross section of the second pin 46 exceeding that of the first pin 44.

Figure 5:
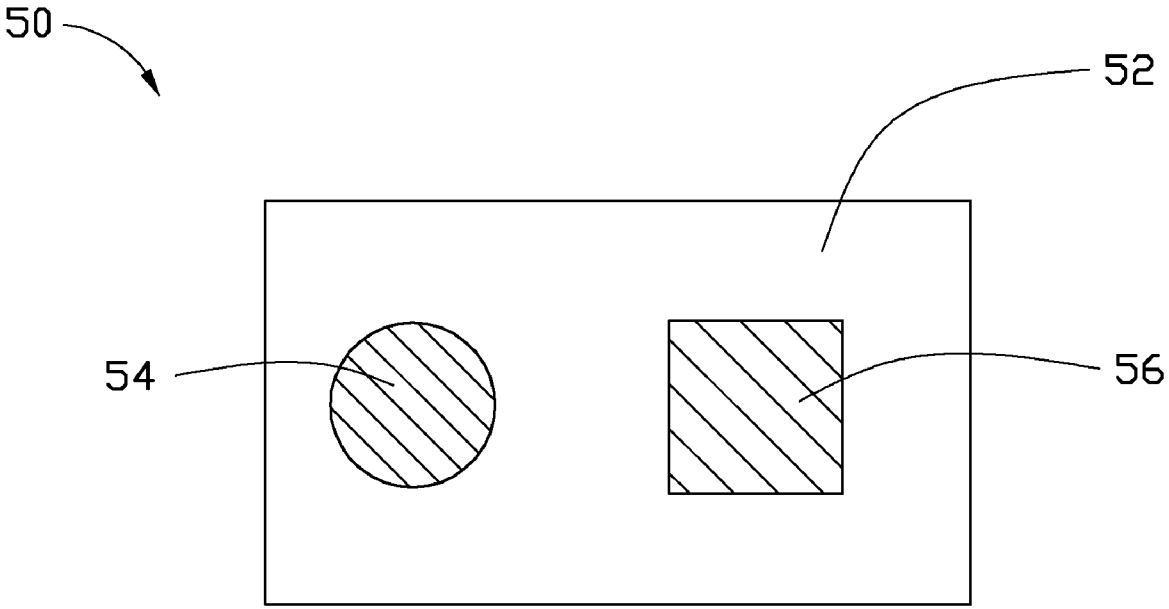
FIG. 5 is a cross section of an insert connector of an electrical connector assembly in accordance with a third embodiment.

FIG. 5 is a cross section of an insert connector 50 of an electrical connector assembly accordingly to a third embodiment. The insert connector 50 is similar to the insert connector 20 of the electrical connector assembly of the first embodiment. In particular, the insert connector 50 includes a main body 52, and a first and a second pins 54, 56 mounted in the main body 52. The insert connector 50 differs from the insert connector 20 of the electrical connector assembly of the first embodiment as follows. The first pin 54 has a circular cross section, while the second pin 56 has a rectangular cross section. At least one of a length and a width of the cross section of the second pin 56 is greater than a diameter of the cross section of the first pin 54. Correspondingly, a receiving connector (not shown) matching the insert connector 50 defines a first and a second through holes to match the first and second pins 54, 56 of the insert connector 50, respectively. The first hole has a shape and a size matching the first pin 54, and the second hole has a shape and a size matching the second pin 56. Thus, the second pin 56 cannot be received in the first through hole, and misconnection between the insert connector 50 and the receiving connector is prevented.

It is to be understood, however, that even though numerous characteristics and advantages of the exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

an insert connector comprising a first pin and a second pin; and a receiving connector defining a first hole and a second hole therein corresponding to the first and second pins of the insert connector, respectively, the first hole having a size and shape matching the first pin, the second hole having a size and shape matching the second pin, the first and second pins of the insert connector being extendable into and engagable in the first and second holes of the receiving connector, respectively;

wherein the first pin has a circular transverse cross section, the second pin has a rectangular transverse cross section, and a transverse cross sectional area of the second pin is larger than that of the first pin, whereby the second pin of the insert connector is prevented from being received in the first through hole of the receiving connector.

2. The electrical connector assembly of claim 1, wherein at least one of a width and a length of the transverse cross section of the second pin is greater than a diameter of the transverse cross section of the first pin.

3. The electrical connector assembly of claim 1, wherein the insert connector further comprises a main body, and the first and second pins extend through the main body and out of the main body.

4. The electrical connector assembly of claim 3, wherein the main body is substantially rectangular, and lengths of the first and second pins protruding out of the main body are the same.

5. An electrical connector assembly with anti-mismatching mating connectors, the electrical connector assembly comprising:

an insert connector comprising a first pin and a second pin, wherein a transverse cross section of the first pin is circular, and a transverse cross section of the second pin is rectangular; and a receiving connector defining a first hole and a second hole therein corresponding to the first and second pins of the insert connector, respectively, the first hole having a size and shape matching the first pin, the second hole having a size and shape matching the second pin, the first and second pins of the insert connector being extendable into and engagable in the first and second holes of the receiving connector, respectively, and the second pin of the insert connector unable to be received in the first through hole of the receiving connector.

6. The electrical connector assembly of claim 5, wherein at least one of a width and a length of the transverse cross section of the second pin is greater than a diameter of the transverse cross section of the first pin.

7. The electrical connector assembly of claim 5, wherein the insert connector further comprises a main body, and the first and second pins extend through the main body and out of the main body.

8. The electrical connector assembly of claim 7, wherein the main body is substantially rectangular, and lengths of the first and second pins protruding out of the main body are the same.

* * * * *